United States Patent [19]

Yagi et al.

[11] Patent Number: 4,728,603

[45] Date of Patent: Mar. 1, 1988

[54] METHOD FOR THE PRODUCTION OF SILVER HALIDE EMULSION

[75] Inventors: Toshihiko Yagi, Hino; Toshifumi Iijima, Kokubunji; Syoji Matsuzaka; Hisashi Yamaguchi, both of Hachioji; Mikio Miura, Hino, all of Japan

[73] Assignee: Konishiroku Photo Industry Co., Ltd., Japan

[21] Appl. No.: 868,156

[22] Filed: May 22, 1986

Related U.S. Application Data

[63] Continuation of Ser. No. 786,720, Oct. 15, 1985, abandoned, which is a continuation of Ser. No. 530,280, Sep. 8, 1983, abandoned.

[30] Foreign Application Priority Data

Sep. 9, 1982 [JP] Japan ..... 57-157636

[51] Int. Cl.[4] ..... G03C 1/02

[52] U.S. Cl. ..... 430/569; 430/567

[58] Field of Search ..... 430/567, 569

[56] References Cited

U.S. PATENT DOCUMENTS

| | | | |
|---|---|---|---|
| 3,000,739 | 9/1961 | Maffet | 430/569 |
| 3,598,593 | 8/1971 | Klinger | 430/567 |
| 3,736,144 | 5/1973 | Nagae et al. | 430/569 |
| 3,821,002 | 6/1974 | Culhane et al. | 430/569 |
| 4,063,951 | 12/1977 | Bogg | 430/569 |
| 4,242,445 | 12/1980 | Saito | 430/569 |
| 4,309,501 | 1/1982 | Huguenard et al. | 430/569 |
| 4,433,048 | 2/1984 | Solberg et al. | 430/567 |

*Primary Examiner*—Richard Schilling

*Attorney, Agent, or Firm*—Finnegan, Henderson, Farabow, Garrett & Dunner

[57] ABSTRACT

The present invention is to provide a method for uniforming a group of silver halide particles of a silver halide emulsion to be used in a silver halide photographic light-sensitive material into a group of particles which is monodispersive and whose crystal habit is tetradecahedral or octahedral so that the complication and instabilization of the conventional particles can be reduced to be processed. Namely, in a process for growing particles in which a water-soluble silver salt is added to a core emulsion and a silver halide is produced to add to the core, this method is to adjust the pAg values of an emulsion being applied to the abovementioned process to increase by not less than 0.3 multistepwise or continuously.

7 Claims, 2 Drawing Figures

METHOD FOR THE PRODUCTION OF SILVER HALIDE EMULSION

This application is a continuation of application, Ser. No. 786,720, filed Oct. 15, 1985, now abandoned, which is a continuation of Ser. No. 530,280 filed on Sept. 8, 1983, now abandoned.

DETAILED DESCRIPTION OF THE INVENTION

BACKGROUND OF THE INVENTION

The present invention relates to a light-sensitive silver halide emulsion, and more particularly to a method for producing stably a monodisperse silver halide emulsion which, after being chemically sensitized, has little fog, a high sensitivity and excellent graininess.

In recent years there have been growing even severe demands for photographic silver halide emulsions; particularly still higher level of demands have been arising for such photographic characteristics as higher sensitivity, more excellent graininess, higher sharpness, lower fog density, more sufficiently high density, and the like.

As a high sensitivity-having emulsion that can meet such demands there is well-known a silver iodobromide emulsion containing from 0 to 10 mole % of iodine. As the method for preparing such an emulsion there are conventionally known such methods using pH or pAg condition control as the ammoniacal method, neutral method, acid method and the like, and such mixing methods as the single jet method, double jet method and the like. On the basis of these known techniques, high level of technical means have been studied and made practical reality for the purpose of attaining further high sensitization, improvement on graininess, excellent sharpness and reduction of fog. In regard to the silver iodobromide emulsion which is the subject of the present invention, studies have been made to produce an emulsion whose crystal habit, granularity distribution, and further the concentration distribution of iodine inside individual silver halide particles are controlled.

The most orthodox method for attaining the above-mentioned photographic characteristics such as high sensitivity, excellent graininess, high sharpness, less fog density, sufficiently high covering power and the like is to improve the quantum efficiency of the silver halide. For this purpose, the knowledge of solid-state physics is positively introduced into it. The study in which the quantum efficiency is theoretically calculated to contemplate the influence thereof upon the granularity distribution is described, e.g., on page 91 of the paper entitled the "Interactions between Light and Materials for Photographic Applications" prepared for the Tokyo Symposium 1980 for the Advancement of Photography. This study predicts that the preparation of a monodisperse emulsion with its granularity distribution narrowed down is effective for the improvement of the quantum efficiency. In addition to this, there is considered reasonable the inference in the study that the monodisperse emulsion would be advantageous also for attaining effectively the high sensitization with keeping the emulsion on a less fog level in the process called chemical sensitization that will be detailed hereinafter.

In order to produce a monodisperse emulsion industrially as described in Japanese Patent Publication Open to Public Inspection (hereinafter referred to as Japanese Patent O.P.I. Publication) No. 48521/1979, there are required the supply speed controls of silver and halide ions in the theoretical amounts each to the reaction system under rigid pAg and pH controls and a sufficient condition of stirring the system.

And it is also known that the configuration of the silver halide particle is made differently according to the pAg during the growth of the silver halide particle. The silver halide emulsion prepared under these conditions is in any one of the regular hexahedral, octahedral and tetradecahedral crystal forms each comprising the so-called regular crystal particles consisting in various proportions of the (100) face to (111) face.

The measurement and control of pAg are monitored to be carried out by the use of apparatus known to those skilled in the art. Typical and effective control apparatus is as described in U.S. Pat. No.3,031,304 and Photographische Korrespondenz vol. 103, pp. 161–164 (1967).

Japanese Patent Examined Publication No.23443/1973 shows that the emulsion of cubic crystal particles comprised of the (100) face prepared under a low pAg condition has fog increased. by a chemical sensitization, and on the other hand, the emulsion of octahedral crystal particles comprised of the (111) face prepared under a high pAg condition has photographically desirable characteristics. However, any negative-type highly sensitive emulsion comprising octahedral silver iodobromide crystal particles is still not made practical reality. It is mainly because of the difficulty in the manufacture of silver halide emulsions comprising a group of monodisperse octahedral crystal particles. The foregoing Japanese Patent Examined Publication No. 23443/1973 suggests that a satisfactory mono dispersibility-having octahedral emulsion can be obtained by changing pAg during the preparation of silver halide particles. However, as it is understood from the report in the Journal of Photographic Science vol. 27, p. 47–53 (1979), even if the pAg were changed in two stages, satisfactory monodispersibility-having octahedral particles could be obtained only in a very limited pAg range. Besides, what is described in the report relates to pure silver bromide, and in such a silver iodobromide or silver iodochloride emulsion as containing a few mole % of iodine it is further difficult to prepare an emulsion compris a group of monodisperse octahedral particles, so that any practically usable emulsion comprising a group of monodisperse octahedral particles has conventionally been unable to be obtained stably.

One reason of the above is that the accuracy of the pAg control in the potential difference measurement is up to the pAg value range of ±0.1, and another is that, in the case of silver iodobromide or silver iodochloride emulsion, with an increase in the silver iodide content percentage, the production of twin and new fine particles becomes increased.

An ideal silver halide emulsion requires the conditions that the particle sizes thereof from a normal distribution whose width is small and the particle's configurations are well uniform. In those conventionally known techniques, the emulsion whose particle size distribution is small and the method for the production thereof are known, and an emulsion comprising regular cubic crystal particles is relatively easier to produce, but in the octahedral or tetradecahedral emulsion, the frequency of twinning was considerably high. In twin particles, generally, their growth rate is high and they tend to become coarse grained, so that the frequency thereof in the number is small but the overally volume thereof occupying the entirety is very large, thus significantly affecting the photographic characteristics. And because twin is capable of taking various configurations, the charactors thereof to the chemical sensitization are largely diversified. Some of them appear as fog even under a relatively weak sensitization condition, and some are hardly sensitive, the so-called dead grain, even under a strong sensitization condition, which causes bad efficiency.

Even useful twin particles that are sensitive to light and normally developable, due to the size thereof, invites undesirably the deterioration of the graininess.

SUMMARY OF THE INVENTION

It is an object of the present invention to provide a method for producing accurately and reproducibly a monodisperse silver halide emulsion in which fog caused by a chemical sensitization is little, the sensitivity thereof is high and the graininess thereof is excellent.

As a result of our continued study to accomplish the above object, we have found a method which enables highly accurately and excellently reproducibly to prepare a silver halide emulsion much improved on the fog, sensitivity and graininess as compared to those obtained by conventional methods.

The object of the present invention is accomplished by the method for the production of a silver halide emulsion as described below:

In a method for the production of a silver halide emulsion comprising silver halide particles consisting essentially of a silver iodobromide or a silver chloroiodobromide containing from 0.5 to 10 mole % of silver iodide, involving a step of adding an aqueous water-soluble silver salt solution and an aqueous water-soluble halide solution to an aqueous hydrophilic solution, the improvement characterized in that the method involves a step of increasing pAg value of said aqueous hydrophilic colloid solution by not less than 0.3 either stepwise involving not less than three steps or continuously and monodispersed silver halide particles of cubic and/or tetradecahedral shape are made present in said hydrophilic colloid solution at the time of initiation of said pAg-increasing step and silver halide particles present in said hydrophilic solution at the time of completion of said pAg-increasing step are in the form of octahedron and/or tetradecahedron.

The production method in the present invention, in a silver ion- halide ion solution system suspension silver halide particles in a solution of a hydrophilic colloid, the so-called silver halide emulsion, is characterized by the increasing condition of pAg in the process where the particle size d of the silver halide particles is increased by the growth due to the new product of silver halide or by the so-called Ostwald growth.

The pAg of the silver halide emulsion when particle size d is increased during the above-mentioned process changes as (1) $\Delta pAg>0$ when reducing or making nil the adding quantity of silver ions against that of halide ions, (2) $\Delta pAg=0$ when balancing the adding quantities including nil of halide and silver ions, and (3) $\Delta pAg>0$ when reducing ions by independently adding or merely removing (by washing, etc.) silver ions, and by a combination of the above conditions, the variations of pAg take various forms, in relation to the increase of particle size d in the aforesaid process, examples of which are as shown in FIG. 1.

In FIG. 1, the axis of ordinate represents pAg, and the axis of abscissa represents particles size d. The particle enters from particle size $d_s$ into this process, and proceeds through an arbitrarily specified particle size $d_0$ and reaches particle size $d_e$.

In FIG. 1, by the combination of the foregoing conditions, line $A_1$ shows an example where pAg increases continuously and monotonously during the period between $d_s$ and $d_e$, line $A_2$ is another example where pAg increases monotonously in broken line, line A3 is of pAg increasing monotonously in multistage, and line $D_1$ is of pAg reducing continuously and monotonously.

In the present invention, at point $d_0$ in the foregoing process, the particle crystal form is cubic or tetradecahedral, and during the period between $d_s$ and $d_e$, therebetween at least one step of increasing in pAg in multistage (at least 3 stages) or continuous monotonously by $\Delta pAg \geqq 0.3$ is involved, and at point $d_e$ tetradecahedral or octahedral particles are made present. In the case of $A_3$ in FIG. 1, it may fall within our invention if pAg at $d_e$ is larger than pAg at $d_0$ by at least 0.3. The upper limit of pAg should be restricted to the level not exceeding the practical pAg's upper limit $pAg_c$ (FIG. 1) for the preparation of emulsion in the field of the present technology, such as, e.g., 10.5 in the silver iodobromide emulsion by the ammoniacal method or 8.5 in the neutral or acidic method.

In FIG. 1 the axis of abscissa relates to particle size d, and even if a particle-size-non-increasing process such as a washing process is contained, it does not appear on the axis.

The method of the present invention may involve a step not increasing in particle size. If the process up to the particle size $d_e$ contains a process of reducing the particle size or causing the decreasing of pAg, the present invention is applied again to the process, starting from the final end thereof.

In the preferred embodiment based upon the experiments of the present invention, the vector ($pAg_d$) to be determined by the above-mentioned monotonous increase in pAg and the particle size increase falls under the range shown in FIG. 2.

In FIG. 2, the axis of ordinate represents pAg, and the $\delta$ axis of abscissa represents $(d/d_0-1)$. In addition, the axis provided underneath and in parallel with the $\delta$ axis is the d axis of the particle sizes corresponding to $\delta$.

In FIG. 2, $pAg_0$ is the pAg at the time of $d_0$, and $d_5$ represents the particle size when the particle volume increased from $d_0$ by 5% by volume. In this instance, $\delta_5$ is $(d_5/d_0-1)$.

When pAg and d are thus settled for pAg adjustments, the foregoing range is specified by the following formulas (1), (2), (3) and (4):

$$pAg \geqq 0.4(d/d_0-1)+pAg_0 \quad (1)$$

$$pAg \geqq 2(d/d_0-1)+(pAg_0+1) \quad (2)$$

$$d \geqq d_O \quad (3)$$

$$d \geqq d_5 \quad (4)$$

Namely, the direction and magnitude of the vector (pAg, d) to which particles proceed along with the growth thereof from the point ($pAg_0$, $d_0$) are, although varying, desirable to always fall under the above range and guided into this range being also variable according to the d variation.

In addition, the intersecting points of the above formulas are point A $\{pAg_0, d_0\}$, point B$\{pAg_0+1.0, d_0\}$point C$\{0.40(d_5/d_0-1)+pAg_0, d_5\}$ and point $D\{2(d_5/d_0-1)+(pAg_0+1.0), d_5\}$, and the abovementioned range is an area that is surrounded by the four lines that connect the points A, B, D, C and A, respectively.

According to the method for the production of a silver halide emulsion in the present invention, even in the high pAg area in which no satisfactory monodisperse silver halide particles have conventionally been obtainable because of the vigorous production of twin and small particles, there occurs no such production, and the pAg area where monodisperse octahedral or tetradecahedral particle group is obtained extends by about 0.5 toward the high pAg side, so that the stability in the manufacture becomes greatly improved. And as the accompanying effect, the time required for the growth of silver halide particles is reduced to below $\frac{2}{3}$.

The effect of the present invention is displayed particularly when the particles' configuration immediate before starting to raise pAg is different from that of the final particles, and particularly the effect is conspicuous when the change in the particles' configuration is large, for example, in the case of changing regular hexahedral particles into octahedral particles.

Namely, it is considered that, in the case of forming octahedral particles from cubic particles, along with the increase of pAg the crystal habits of the particles corresponding to the circumstances of the pAg will usually vary into a cube-tetrahedron-octahedron, however, in the process of growing into octahedral or tetradecahedral particles, those particles having different crystal habit from that of the particle's crystal habit (equilibrium crystal habit) that is stable under the pAg condition are hardly growable because of a smaller proportional growth rate upon the particle size even if the size is large, and on the other hand, when the equilibrium crystal habit coincides with the crystal habit of the particles, the proportional growth rate upon the particle size becomes larger and the particle size distribution is widened, and for another reason different from this, the twin's growing probability becomes increased.

In the light of the fact that the effect of the present invention is displayed by changing the pAg in not less than three stages or continuously during the course of the growth into octahedral and tetradecahedral particles, it is presumed that the growth reaction may be controlled to transform monodispersewise into tetradeca- or octahedron according to the combination of the equilibrium crystal habit of silver halide particles under the growing condition and the configuration of the silver halide particle during the time thereof.

The effect of the present invention is particularly conspicuous in producing a silver iodobromide or silver chloroiodobromide emulsion containing AgI within the quantity range of from 0.5 to 0 mole %, and in the case of pure silver bromide, even a conventional producing method permits the obtaining of an objective silver halide emulsion, and in the case of silver iodobromide or silver chloroiodobromide emulsion containing AgI in a quantity exceeding 10 mole %, it is difficult to obtain an objective silver halide emulsion by the method of the present invention.

The preferred silver chloride content percentage is less than 1 mole %, and more preferably zero.

In the present invention, the internal composition of the silver iodobromide and silver chloroiodobromide particle is allowed to be either uniform or unevenly distributed. And the surface of the silver halide emulsion particle produced in accordance with the method of the present invention may be covered with a shell having a limited thickness as shown in Japanese Patent O.P.I. Publication No. 154232/1982.

The present invention is suitable for the production of a monodisperse silver iodobromide or silver chloroiodobromide emulsion comprising silver halide octahedral or tetradecahedral crystal particles. The "monodisperse emulsion" used herein means an emulsion having a granularity distribution which is not more than such a certain proportion as shown below of the dispersion of the particle sizes of the silver halide particles contained therein to the mean particle size thereof. The granularity of an emulsion comprising a group of particles whose configurations are uniform and whose particle sizes' dispersion is small (which emulsion is hereinafter called "monodisperse emulsion") forms a nearly normal distribution, so that the standard deviation thereof can be easily found, and if the extent of the distribution is as defined by the relational formula:

$$\frac{\text{Standard deviation}}{\text{Mean Particle size}} \times 100 = \text{Variation coefficient (\%)}$$

the variation coefficient of the silver halide particles in the present invention is not more than 15%, and more preferably not more than 10% having monodispersibility.

The silver halide emulsion prepared by the method of the present invention is usable when growing it from seed particles and also when growing it with no seed particles. The silver halide particles used as the seed are desirable to be monodisperse, and the silver halide composition thereof may be any of silver chloride, silver bromide, silver iodide, silver iodobromide, silver chlorobromide and silver chloroiodobromide.

In the method for the production of a silver halide in the present invention, not less than one time the process of changing pAg may be incorporated. Particularly, the process for the production of highly sensitive particles of a large size is desirable to contain not less than two times this process. Further, in the method for the production of a silver halide emulsion in the present invention, at arbitrary points of time during the period up to the completion of the addition of a necessary amount of water-soluble salts for use in the preparation of an emulsion there may be incorporated not less than one time the process for removing such salts or compounds as an excess of halides produced during the preparation of the emulsion, a byproduct or disused nitrate, ammonia, and the like.

The silver halide emulsion in this invention may be subjected to a reduction sensitization at an arbitrary point of tim during the manufacturing process thereof.

The reduction sensitization is carried out by leaving it under a low pAg condition, that is, by silver ripening, or otherwise by the addition of an appropriate reducing agent such as tin chloride, dimethylamineborane, hydrazine, thiourea dioxide, etc. The light-sensitive silver halide emulsion of the invention, when the silver halide precipitates, during the growth of the particles, or after completion of the growth, may be doped with various metallic salts or metallic complex salts, such as, e.g., of gold, platinum, palladium, iridium, rhodium, bismuth, cadmium, copper, etc., and the combination of some of such salts.

Such salts or compounds as an excess of the halides produced, and nitrates or ammonia secondarily produced or disused during the preparation of the emulsion of the invention may be removed. The removal may be carried out by the application of the noodle washing, dialysis, or coagulation precipitation, and the like, which are usually used in the preparation of general emulsions.

The emulsion of the invention may be sensitized by various chemical sensitization methods which are applied to general emulsions. The chemical sensitization may be made by the single use or combined use of chemical sensitizers which include such noble-metallic sensitizers as active gelatin, water-soluble gold salts, water-soluble platinum salts, water-soluble palladium salts, water-soluble rhodium salts, water-soluble iridium salts, etc.; sulfur sensitizers; selenium sensitizers; the foregoing reduction sensitizers; and the like. Further, the silver halide may be optically sensitized to any desired wavelength region. No special restrictions are put on the optical sensitization methods for the emulsion of the present invention, and the optical sensitization may be effected by the single use or combined use (for, e.g., supersensitization) of optical sensitizers which include such cyanine dyes as zero-methine dyes, monomethine dyes, dimethine dyes, trimethine dyes, etc.; or merocyanine dyes; and the like. Those techniques for the optical sensitization are described in U.S. Pat. Nos.2,688,545, 2,912,329, 3,397,060, 3,615,635 and 3,628,964, British Pat. Nos. 1,195,302, 1,242,588 and 1,293,862, West German OLS Pat. Nos.2,030,326 and 2,121,780, and Japanese Patent Examined Publication Nos.4936/1968 and 14030/1969, and the like. The selection from such sensitizers may be made arbitrarily according to the sensitivity and wavelength region desired to be sensitized, and the purpose and use of the objective light-sensitive material.

The monodispersive silver halide emulsion of the present invention may be used with its granularity distribution kept intact or may also be used preparing, so as to obtain a given gradation, by blending not less than two monodispersive emulsions different in the mean particle size from each other at an arbitrary point of time after the formation of the particles thereof. However, in the method of the invention, it is also allowed to make coexist with an emulsion containing those silver halide particles outside the present invention within the range of not impairing the effect of the present invention.

The hydrophilic colloid for use in the preparation of the emulsion according to the present invention includes not only gelatin (either lime-treated or acid-treated) but also such gelatin derivatives as those gelatin derivatives produced by the reaction of gelatin with aromatic sulfonyl chloride, with acid chlorides, with acid anhydrides, and with isocyanate 1,4-diketones as described in U.S. Pat. No. 2,614,928; those gelatin derivatives produced by the reaction of gelatin with trimellitic acid anhydrides as described in U.S. Pat. No. 3,118,766; those gelatin derivatives produced by the reaction of gelatin with organic acids having active halogen as described in Japanese Patent Examined Publication No. 5514/1964; those gelatin derivatives obtained by the reaction of gelatin with aromatic glycidol ethers as described in Japanese Patent Examined Publication No. 26845/1967 ; those gelatin derivatives produced by the reaction of gelatin with maleimide, maleamic acid, unsaturated aliphatic diamide, etc., as described in U.S. Pat. No. 3,186,846; sulfoalkylated gelatin as described in British Pat. No. 1,033,189; polyoxyalkylene derivatives of gelatin as described in U.S. Pat. No. 3,312,553; such graft-polymerized gelatins as, e.g., those produced by grafting gelatin with the single or combined compounds of, e.g., acrylic acid, methacrylic acid, esters of these with monohydric or polyhydric alcohols, amide, acryl or methacryl, nitrile, styrene and other vinyl-type monomers; those homopolymers or copolymers produced from such monomers as synthetic hydrophilic high molecular compounds such as, e.g., vinyl alcohol, N-vinyl-pyrolidone, hydroxyalkyl-(meth)acrylate, (meth) acrylamide, N-substituted (meth)acrylamide, etc., copolymers of these with acrylic acid esters, vinyl acetate, styrene, etc., and such copolymers of any one of the above with maleic anhydride, maleamid acid, and the like; and further non-gelatin natural hydrophilic high molecular materials such as casein, agaragar, alginic acid polysaccharides, etc., which materials may also be used singly or in a mixture form.

The emulsion of the invention is allowed to contain various ordinarily usable additives according to purposes. These additives include such stabilizers or antifoggants as, e.g., azaindenes, triazoles, tetrazoles, imidazoliums, tetrazoliums, polyhydroxy compounds, etc.; such hardeners as, e.g., aldehyde-type, aziridine-type, isooxazol-type, vinylsulfone-type, acryloyl-type, carbodiimid-type, maleimide-type, methanesulfonate-type, triazine-type compounds; such development accelerators as, e.g., benzyl alcohol, polyoxyethylene compounds; such image stabilizers as, e.g., chroman-type, chraman-type, bisphenol-type, phosphorous acid ester-type compounds; such lubricants as, e.g., wax, glycerides of higher fatty acids, higher alcohol esters of higher fatty acids, etc.; and the like. And as surface active agents, there may be used those anionic, cationic, nonionic, or amphoteric ionic ones asa coating aid, as the agent for improving the permeability of processing liquids, as a defoaming agent or as the agent for the control of various physical properties of the light-sensitive material As antistatic agents there may be effectively used alkaline salts of the reaction products of 4-aminobenzene-sulfonic acid with diacetyl cellulose, styrene-fluoroalkyl-sodium maleate copolymer, and with styrene-maleic anhydride copolymer, and the like. As matting agents, polymethyl methacrylate, polystyrene, alkali-soluble polymers, and the like, may be used. Further, colloidal silicon oxide may also be used. Latexes to be added for the improvement of the physical properties of the layer include, copolymers formed by acrylic acid esters and vinyl esters with another monomer having ethylene group. Gelatin plasticizers include glycerol and glycol-type compounds. Viscosity-increasing agents include styrene-sodium maleate copolymers, alkyl-vinyl ether-maleic acid copolymers, and the like.

Materials usable for the support of the light-sensitive material produced by use of the emulsion thus prepared according to the present invention include baryta paper, polyethylene-coated paper, polypropylene synthetic paper, glass paper, cellulose acetate, cellulose nitrate, polyvinyl acetal, polypropylene, polyester film such as, e.g., polyethylene terephthalate, etc., polystyrene, and the like. And these materials for the support may be arbitrarily selected to be used according to uses of individual silver halide photographic light-sensitive materials.

These support materials may, if necessary, be coated thereover with a subbing layer.

The emulsion of the invention may be effectively applied to various light-sensitive materials such as those for general black-and-white photography use, for X-ray use, for color photography use, for infrared photography use, for micrographix use, for the silver-dye bleach process use, for the reversal process use, for the diffusion transfer process use, and the like.

In order to obtain a wide latitude characteristic by use of the emulsion of the invention, at least two monodispersive emulsions different in the mean particle size or in the sensitivity are mixed or double-coated, whereby a light-sensitive material having an abundant latitude and a high covering power, requiring only a small coating amount of silver due to the characteristics of the emulsion of the invention, i.e., having a high optical density, can be obtained.

In order to apply the emulsion of the invention to a color light-sensitive material, the emulsion of the invention should be made red-sensitive, green-sensitive and blue-sensitive, into which are then incorporated cyan, magenta and yellow couplers in combination, and the like,—thus such procedures and such materials as generally usable for ordinary color light-sensitive materials may be applied. As the yellow coupler, those known open-chain ketomethylene-type couplers may be used, among which benzoyl-acetanilied-type and pivaloyl-acetanilied-type compounds are useful. As the magenta coupler, there may be used pyrazol-one-type compounds, indazolone-type compounds, cyanoacetyl compounds, and as the cyan coupler, there may be used phenol-type, naphthol-type compounds, and the like.

The light-sensitive material produced by use of the emulsion of the present invention, after being exposed to light, may be developed in any of the known, generally used manners.

A black-and-white developer solution is an aqueous alkaline solution containing a developing agent such as a hydroxybenzene, an aminophenol, an aminobenzene, or the like, and the solution is allowed to also contain a sulfite, carbonate, hydrogensulfite, bromide and iodide of an alkali metal. If the light-sensitive material is for color photography use, it may be processed in a normally used color developer solution. In the reversal process, the light-sensitive material is first developed in a developer for black-and-white negative material development, and then exposed to white light or processed in a bath containing a fogging agent, and further processed in an alkaline developer solution containing a color developing agent. No special restrictions are put on the processing method; any methods can be applied, for example, most typical ones of which include a process that a color development is followed by a bleach-fix bath processing and further, if necessary, by washing and stabilizing, and another that after a color development, a bleaching and a fixing are separately made which, if necessary, are followed by washing and then by stabilizing.

Figure 1:
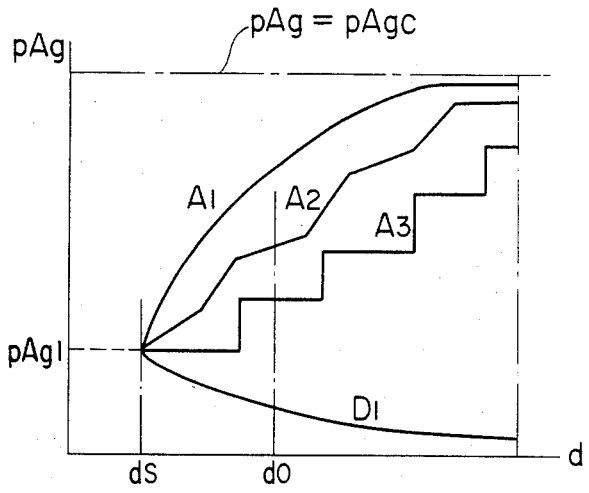
FIG. 1 is an explanatory drawing showing the form of variation of pAg in the process of the growth of the emulsion particle size, wherein the axis of ordinate represents pAg and the axis of abscissa represents particle sizes; a continuously curved line $A_1$, a bended line $A_2$ and a multistepped line $A_3$ represent the respective pAg variations which monotonously increase pAg occurring in the processes of the growth in particle sizes from the size $d_s$ at the start of the growth to the size $d_e$ at the time of the completion thereof through the size $d_0$ in the intermediate progress and a curve $D_1$ represents the continuously monotonuous decrease thereof.
Figure 2:
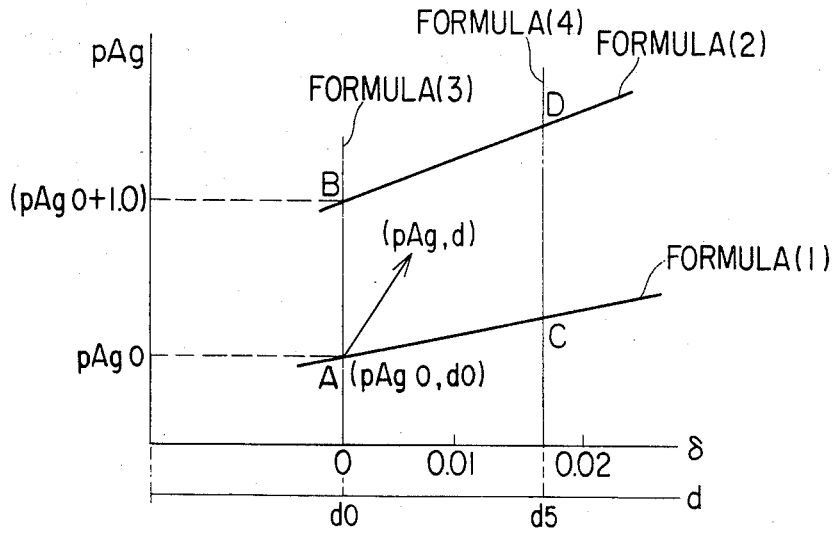
FIG. 2 is an explanatory drawing showing a quadrangle A B C D which represents the preferred scope of the vector (pAg, d) exhibiting the directions and magnitudes of the monotonous increases of pAg and the increases of a particle size d in the invention, and in this figure, the axis of abscissa is a $\delta$ axis defined by $\delta=(d/d_0-1)$ and the axis underneath this axis is the axis for the particle size d corresponding to the $\delta$ axis. The axis of ordinate is the axis for pAg.

Next, the present invention is illustrated in detail with reference to examples below, but the present invention is not limited thereto.

Comparative Example 1

The following six different solutions were used to prepare a silver iodobromide emulsion containing 2.5 mole % of silver iodide. EM-1 used as the seed emulsion is a cubic silver iodobromide emulsion containing 2 mole % of silver iodide. The emulsion's mean particle size is 0.3$\mu$m, and the coefficient of the variation of the particles is 10%.

| | |
|---|---|
| **Solution A-1** | |
| Ossein gelatin | 55 g |
| Distilled water | 6800 ml |
| 10% aqueous ethanol solution of polyisopropylene-polyethyleneoxy-disuccinic acid ester sodium salt | 8 ml |
| 56% acetic acid | 66 ml |
| 28% aqueous ammonia | 110 ml |
| Seed emulsion (EM-1) | 0.737 mole |
| **Solution B-1** | |
| Ossein gelatin | 64 g |
| KBr | 784.8 g |
| KI | 28.1 g |
| Add distilled water to made | 3221 ml |
| **Solution D-1** | |
| $AgNO_3$ | 1149 g |
| Distilled water | 1500 ml |
| 28% aqueous ammonia | 965 ml |
| Add distilled water to make | 3221 ml |
| **Solution E-1** | |
| 50% aqueous KBr solution | 500 ml |
| **Solution F-1** | |
| 56% aqueous acetic acid solution | 2000 ml |
| **Solution G-1** | |
| KBr | 30 g |
| Distilled water | 118 ml |

By use of a mixing stirrer that is disclosed in Japanese Patent O.P.I. Publication Nos. 92523/1982 and 92524/1982, at 40° C., to Solution A-1 were simultaneously added Solution D-1 and Solution B-1 by the simultaneously mixing method, spending 64.5 minutes that is the minimum time not to cause any small particles to grow midway. The pAg, pH and the adding rate of Solution D-1 during the simultaneous mixing were contnrolled as shown in Table 1. The controls of pAg and pH were made with changing the flows of Solution E-1, Solution F-1 and Solution B-1 by a flow-variable roller tube pump.

Two minutes after completion of the addition of Solution D-1, Solution G-1 was added and further 2 minutes later,t he pH was adjusted to 6.0 by use of solution F-1.

TABLE 1

| Time | pAg | pH | Adding rate of Solution D-1 (ml/min.) |
|---|---|---|---|
| 0.0 | 9.65 | 9.00 | 15.5 |
| 9.65 | 9.65 | 8.93 | 30.6 |
| 15.26 | 9.65 | 8.87 | 46.9 |
| 21.43 | 9.65 | 8.76 | 69.9 |
| 27.47 | 9.65 | 8.61 | 95.6 |
| | | | Suspended for pAg adjustment |
| 28.47 | 10.0 | 8.61 | 47.0 |
| 39.58 | 10.0 | 8.44 | 54.1 |
| 47.34 | 10.0 | 8.31 | 55.9 |
| 55.05 | 10.0 | 8.18 | 54.7 |
| 64.45 | 10.0 | 8.05 | 52.5 |

The mixture was then washed for desalting in usual manner and dispersed into an aqueous solution containing 106 g of ossein gelatin, and after that, distilled water was added to it to make its whole quantity 3190 ml. This emulsion was regarded as EM-2. The silver halide particles of EM-2 were observed through an electron microscope, and as a result it was found that the coefficient of variation in the particle sizes is 8%, and the emulsion contains 10% twin particles with the rest octahedral particles whose particle size is 0.65μm in terms of a side length of a cube equivalent in the volume thereto.

EXAMPLE 1

The following five different solutions were used to prepare a silver iodobromide emulsion containing 2.5 mole % of silver iodide in accordance with the method of the present invention. EM-1 as the seed emulsion is a cubic silver iodobromide emulsion containing 2 mole % of silver iodide. The emulsion's mean particle's side length is 0.3 μm, and the coefficient of variation in the particle sizes is 10%.

| | |
|---|---|
| **Solution A-2** | |
| Ossein gelatin | 55 g |
| Distilled water | 6800 ml |
| 10% aqueous ethanol solution of polyisopropylene-polyethyleneoxy-disuccinic acid ester sodium salt | 8 ml |
| 56% acetic acid | 66 ml |
| 28% aqueous ammonia | 110 ml |
| Seed emulsion (EM-1) | 0.737 mole |
| **Solution B-2** | |
| Ossein gelatin | 64 g |
| KBr | 784.8 g |
| KI | 28.1 g |
| Distilled water to make | 3221 ml |
| **Solution D-2** | |
| $AgNO_3$ | 1149 g |
| Distilled water | 1500 ml |
| 28% aqueous ammonia | 965 ml |
| Distilled water to make | 3221 ml |
| **Solution E-2** | |
| 50% aqueous KBr solution | 500 ml |
| **Solution F-2** | |
| 56% aqueous acetic acid solution | 2000 ml |

By use of a mixing stirrer that is disclosed in Japanese Patent O.P.I. Publication Nos. 92523/1982 and 92524/1982, at 40° C., to Solution A-2 were simultaneously added Solution D-2 and Solution B-2 by the simultaneously mixing method, spending 27.6 minutes that is the minimum time not to cause any small particles to grow midway. The pAg, pH and the adding rate of Solution D-2 during the simultaneous mixing were controlled as shown in Table 2. The controls of pAg and pH were made with changing the flows of Solution E-2, Solution F-2 and Solution B-2 by a flow-variable roller tube pump.

Two minutes after completion of the addition of Solution D-2, the pH was adjusted to 6.0 by use of Solution F-2.

TABLE 2

| Time (min) | pAg | pH | Adding rate of Solution D-2 (ml/min.) |
|---|---|---|---|
| 0.0 | 9.30 | 9.00 | 46.8 |
| 1.31 | 9.30 | 8.97 | 61.5 |
| 2.55 | 9.60 | 8.95 | 53.8 |
| 3.79 | 9.65 | 8.93 | 61.2 |
| 9.15 | 9.65 | 8.78 | 131.0 |
| 12.32 | 9.65 | 8.63 | 183.3 |
| 15.62 | 10.01 | 8.46 | 157.2 |
| 20.51 | 10.40 | 8.27 | 113.0 |
| 23.68 | 10.40 | 8.16 | 111.6 |
| 27.57 | 10.40 | 8.05 | 110.1 |

The mixture was then washed for desalting in usual manner and dispersed into an aqueous solution containing 106 g of ossein gelatin, and after that, distilled water was added to it to make its whole quantity 3190ml. The resulting emlsuion was regarded as EM-3. The silver halide particles of EM-3 were observed through an electron microscope, and as a result it was found that the extent of the particle size distribution is 7%, and the emulsion contains 3% twin particles with the rest octahedral particles whose particle size is 0.65μm is terms of a side length of a cube equivalent in the volume thereto. It is apparatus that the extent of the particle size distribution as well as the growing frequency of twin particles is improved as compared to the comparative emulsion EM-2 prepared in the conventional manner.

It is very surprising that the final pAg values show 10.0 and 10.5; the invention's result is 0.5 higher and yet is even lower in the growing frequency of twin particles than the comparative one. When comparing in the minimum adding time with no growth of small particles, the invention's result is reduced to one half.

300 ml were taken from each of EM-2 and EM-3, and 0.2 ml of 0.25% hypo solution was added to it at 60° C., and each was ripened for 60 minutes. Subsequently 0.3 ml of 0.2% aqueous chloroauric acid solution was added to this and the mixture was then further ripened, during which parts of the mixture were taken separately at two points of the ripening time: 70 minutes and 120 minutes after the addition, and each part was subjected to a sensitometry evaluation.

After completion of the ripening, 4-hydroxy-6-methyl-l,3, 3*a*,7-tetrazaindene was added. After that, to each of the emulsions were added such ordinary photographic additives as coating aid, viscosity increasing agent and hardener, and then the resulting emulsions each was coated and dried in an ordinary manner on a subbed polyethylene terephthalate film base so that the amount of Ag is 50 mg/100cm$^2$, thereby preparing samples No. 1 to No. 4.

Each of the samples wass exposed for 1/50 sec. through an optical wedge to a light source of color temperature 5400° K. The exposure was 3.2 CMS. Each of the samples, after the exposure, was developed in the following developer at 35° C. for 30 seconds.

| Developer: | |
|---|---|
| Anhydrous sodium sulfite | 70 g |
| Hydroquinone | 10 g |
| Boric anhydride | 1 g |
| Sodium carbonate, monohydrated | 20 g |
| 1-phenyl-3-pyrazolidone | 0.35 g |
| Sodium hydroxide | 5 g |
| 5-methyl-benzotriazole | 0.05 g |
| Potassium bromide | 5 g |
| Glutaraldehyde hydrogensulfite | 15 g |
| Glacial acetic acid | 8 g |
| Water to make 1 liter | |

Graininess (RMS) was evaluated by comparing the standard deviations of changes in the density value obtained when scanning the transmission density of 0.7 by means of a microdensitometer whose circular scanning head diameter is 50 μm. The obtained results are as shown in Table 3.

TABLE 3

| Sample No. | Emulsion No. | Ripening time (min) | Sensitivity | Fog | γ | RMS |
|---|---|---|---|---|---|---|
| 1 | EM-2 | 70 | 90 | 0.06 | 4.72 | 0.070 |
| 2 | EM-2 | 120 | 94 | 0.15 | 4.80 | 0.070 |
| 3 | EM-3 (invention) | 70 | 100 | 0.06 | 4.80 | 0.063 |
| 4 | EM-3 (invention) | 120 | 120 | 0.08 | 4.95 | 0.063 |

The sensitivity is the reciprocal of the exposure that gives fog +0.4, and the sensitivities of the samples are given in the table with relative values when the sensitivity of sample No.3 is regarded as 100.

From the results shown in Table 3 it is apparent that EM-3 prepared in accordance with the production method of the present invention produces fog gently at the time of chemical sensitization, and is improved on the resulting sensitivity itself as well as on the graininess (RMS) as compared to EM-2 prepared in the conventional manner.

COMPARATIVE EXAMPLE 2

The following seven different solutions were used to prepare a silver iodobromide emulsion containing 2.5 mole % of silver iodide. EM-1 as the seed emulsion is a cubic silver iodobromide emulsion containing 2 mole % of silver iodide. The emulsion's mean particle's side length is 0.3 μm, and the extent of the distribution of the particles is 10%.

| Solution A-3 | |
|---|---|
| Ossein gelatin | 72.5 g |
| Distilled water | 7250 ml |
| 10% aqueous ethanol solution of polyisopropylene-polyethyleneoxy-disuccinic acid ester sodium salt | 8 ml |
| 56% acetic acid | 66 ml |
| 28% aqueous ammonia | 110 ml |
| Seed emulsion (EM-1) | 0.123 mole |
| **Solution B-3** | |
| Ossein gelatin | 60 g |
| KBr | 600.6 g |
| KI | 21.5 g |
| Distilled water to make | 2465 ml |
| **Solution C-3** | |
| Ossein gelatin | 10 g |
| KBr | 127 g |
| Distilled water to make | 509 ml |
| **Solution D-3** | |
| $AgNO_3$ | 1061 g |

-continued

| | |
|---|---|
| Distilled water | 1000 ml |
| 28% aqueous ammonia | 891 ml |
| Distilled water to make | 2974 ml |
| **Solution E-3** | |
| 50% aqueous KBr solution | 500 ml |
| **Solution F-3** | |
| 56% aqueous acetic acid solution | 2000 ml |
| **Solution G-3** | |
| KBr | 50 g |
| Distilled water | 118 ml |

By use of a mixing stirrer that is disclosed in Japanese Patent O.P.I. Publication Nos. 92523/1982 and 19524/1982, at 40° C. to Solution A-3 were simultaneously added Solution D-3 and Solution B-3 by the simultaneously mixing method, spending 139 minutes that is the minimum time not to cause any small particles to grow midway. The addition was followed by another simultaneous addition of Solution D-3 and Solution C-3, spending 11.6 minutes, the minimum adding time which causes no growth of small particles. The pAg, pH and the adding rate of Solution D-3 during the simultaneous mixing were controlled as shown in Table 4. The controls of pAg and pH were made with changing the flows of Solution E-3, Solution F-3 and Solution B-3 by a flow-variable roller tube pump.

Two minutes after completion of the addition of Solution D-3, the pH was adjusted to 6.0 by use of Solution F-3. The mixture was then washed for desalting, and dispersed into an aqueous solution containing 106 g of ossein gelatin, and after that distilled water was added to it to make its whole quantity 3190 ml. This emulsion was regarded as EM-4. The silver halide particles of EM-4 were examined under an electron microscope, and as a result, it was found that the extent of the particle size distribution is 9%, and the emulsion contains 18% twin particles with the rent octahedral particles whose particle size is 1.18 μm in terms of a side length of a cube equivalent in the volume thereto.

TABLE 4

| Time | pAg | pH | Adding rate of Solution D-3 (ml/min.) |
|---|---|---|---|
| 0.0 | 9.85 | 9.00 | 2.08 |
| 23.39 | 9.85 | 8.97 | 4.02 |
| 37.63 | 9.85 | 8.95 | 6.00 |
| 47.79 | 9.85 | 8.93 | 8.06 |
| 55.62 | 9.85 | 8.91 | 10.1 |
| 61.96 | 9.85 | 8.89 | 12.3 |
| 82.67 | 9.85 | 8.78 | 23.2 |
| 101.67 | 9.85 | 8.61 | 37.1 |
| 121.37 | 9.85 | 8.37 | 48.5 |
| 149.58 | 9.85 | 7.99 | 46.8 |

Comparative Example 3

The following seven different solutions were used to prepare a silver iodobromide emulsion containing 2.5 mole % of silver iodide. EM-1 as the seed emulsion is a cubic silver iodobromide emulsion containing 2 mole % of silver iodide. The emulsion's mean particle's side length is 0.3 μm, and the extent of the distribution of the particles is 10%.

| Solution A-4 | |
|---|---|
| Ossein gelatin | 72.5 g |

-continued

| | |
|---|---|
| Distilled water | 7250 ml |
| 10% aqueous ethanol solution of polyisopropylene-polyethyleneoxy-disuccinic acid ester sodium salt | 8 ml |
| 56% acetic acid | 66 ml |
| 28% aqueous ammonia | 110 ml |
| Seed emulsion (EM-1) | 0.123 mole |
| **Solution B-4** | |
| Ossein gelatin | 60 g |
| KBr | 600.6 g |
| KI | 21.5 g |
| Distilled water to make | 2465 ml |
| **Solution C-4** | |
| Ossein gelatin | 10 g |
| KBr | 127 g |
| Distilled water to make | 509 ml |
| **Solution D-4** | |
| $AgNO_3$ | 1061 g |
| Distilled water | 1000 ml |
| 28% aqueous ammonia | 891 ml |
| Distilled water to make | 2974 ml |
| **Solution E-4** | |
| 50% aqueous KBr solution | 500 ml |
| **Solution F-4** | |
| 56% aqueous acetic acid solution | 2000 ml |
| **Solution G-4** | |
| KBr | 30 g |
| Distilled water | 118 ml |

By use of a mixing stirrer that is disclosed in Japanese Patent O.P.I. Publication Nos. 92523/1982 and 92524/1982, at 40° C., to Solution A-4 were simultaneously added Solution D-4 and Solution B-4 by the simultaneously mixing method, spending 14.7 minutes that is the minimum adding time to cause no growth of small particles midway. The addition was followed by another simultaneous addition of Solution D-4 and Solution C-4, spending 18.7 minutes, the minimum adding time which causes no growth of small particles. The pAg and pH and the adding rate of Solution D-4 during the simultaneous mixing were controlled as shown in Table 5. The controls of pAg and pH were made with changing the flows of Solution E-4, Solution F-4 and Solution B-4 or Solution C-4 by a flow-variable roller tube pum.

Two minutes after completion of the addition of Solution D-4, the pH was adjusted to 6.0 by use of Solution F-4.

TABLE 5

| Time | pAg | pH | Adding rate of Solution D-4 (ml/min.) |
|---|---|---|---|
| 0.0 | 9.65 | 9.00 | 2.6 |
| 38.25 | 9.65 | 8.93 | 10.1 |
| 60.74 | 9.65 | 8.82 | 23.2 |
| 75.19 | 9.65 | 8.69 | 36.8 |
| 82.25 | 9.65 | 8.61 | 44.3 |
| | | | Suspended for pAg adjustment |
| 83.25 | 10.0 | 8.61 | 22.2 |
| 103.8 | 10.0 | 8.46 | 25.9 |
| 122.3 | 10.0 | 8.31 | 27.8 |
| 142.9 | 10.0 | 8.14 | 27.2 |
| 166.9 | 10.0 | 7.99 | 26.6 |

The mixture was then washed desalting, and dispersed into an aqueous solution containing 106 g of ossein gelatin, and after that distilled water was added to it to make its whole quantity 3190 ml. This emulsion was retgarded as EM-5. The silver halide particles of EM-5 were examined under an electron microscope, and as a result, it was found that the extent of the particle size distribution is 8%, and the emulsion contains 9% twin particles with the rest octahedral particles whose particle size is 1.18 μm in terms of a side length of a cube equivalent in the volume thereto.

EXAMPLE 2

The following seven different solutions were used to prepare a silver iodobromide emulsion containing 2.5 mole % of silver iodide in accordance with the production method of this invention. EM-3 used as the seed emulsion in accordance with the method of the present invention is an octahedral silver iodobromide emulsion containing 2 mole % of silver iodide. The mean particle size of the seed emulsion is 0.65 μm in terms of a side strength of a cube equivalent in the volume to the particle, and the extent of the particle size distribution is 7%.

| | |
|---|---|
| **Solution A-5** | |
| Ossein gelatin | 51 g |
| Distilled water | 6800 ml |
| 10% aqueous ethanol solution of polyisopropylene-polyethyleneoxy-disuccinic acid ester sodium salt | 8 ml |
| 56% acetic acid | 66 ml |
| 28% aqueous ammonia | 110 ml |
| Seed emulsion (EM-3) | 1.25 mole |
| **Solution B-5** | |
| Ossein gelatin | 49 g |
| KBr | 600.6 g |
| KI | 21.5 g |
| Distilled water to make | 2465 ml |
| **Solution C-5** | |
| Ossein gelatin | 10 g |
| KBr | 127 g |
| Distilled water to make | 509 ml |
| **Solution D-5** | |
| $AgNO_3$ | 1061 g |
| Distilled water | 1000 ml |
| 28% aqueous ammonia | 891 ml |
| Distilled water to make | 2974 ml |
| **Solution E-5** | |
| 50% aqueous KBr solution | 500 ml |
| **Solution F-5** | |
| 56% aqueous acetic acid solution | 2000 ml |
| **Solution G-5** | |
| KBr | 12.5 g |
| Distilled water | 118 ml |

By use of a mixing stirrer that is disclosed in Japanese Patent O.P.I. Publication Nos. 92523/1982 and 92524/1982, at 40° C., to Solution A-5 were simultaneously added Solution D-5 and Solution B-5 by the simultaneously mixing method, spending 46.4 minutes that is the minimum adding time to cause no growth of small particles midway. The addition was followed by another simultaneous addition of Solution D-5 and Solution C-5, spending 10.3 minutes, the minimum adding time which causes no growth of small particles. The pAg and pH and the adding rate of Solution D-5 during the simultaneous mixing were controlled as shown in Table 6. The controls of pAg and pH were made with charging the flows of Solution E-5, Solution F-5 and Solution B-5 or Solution C-5 by a flow-variable roller tube pump.

Two minutes after completion of the addition of Solution D-5, Solution G-5 was added and further 2 minutes later the pH was adjusted to 6.0 by use of Solution F-5.

TABLE 6

| Time (min) | pAg | pH | Adding rate of Solution D-5 (ml/min.) |
|---|---|---|---|
| 0.0 | 9.65 | 9.00 | 17.5 |
| 9.12 | 9.65 | 8.93 | 30.7 |
| 16.45 | 9.65 | 8.84 | 48.0 |
| 22.76 | 9.65 | 8.74 | 65.7 |
| 27.65 | 9.65 | 8.63 | 79.6 |
| 32.22 | 9.85 | 8.52 | 76.2 |
| 38.26 | 10.08 | 8.39 | 64.7 |
| 45.65 | 10.30 | 8.27 | 52.7 |
| 51.11 | 10.30 | 8.18 | 51.9 |
| 56.70 | 10.30 | 8.09 | 50.3 |

The mixture was then washed for desalting in usual manner, and dispersed into an aqueous solution containing 106 g of ossein gelatin, and after that distilled water was added to it to make its whole quantity 3190 ml. This emulsion was regarded as EM-6. The silver halide particles of EM-6 were examined under an electron microscope, and as a result it was found that the extent of the particle size distribution is 7%, and the emulsion contains 3% twin particles with the rest octahedral particles whose particle size is 1.18 μm in terms of a side length of a cube equivalent in the volume thereto.

As apparent from the results, as compared to the comparative emulsions EM-4 and EM-5 prepared in the conventional manner, the emulsion by the method of the present invention is improved on the extent of the particle size distribution as well as on the growing frequency of twin particles. EM-6 by the method of the present invention shows higher pAg value than the pAg values 9.85 in EM-4 and 10.0 in EM-5, and yet has even lower frequency of the growth of twin particles, so that in the method of the invention, the stable growth region of octahedral particles becomes largely wider.

300 ml were taken from each of EM-4, EM-5 and EM-6, and to each emulsion was added at 60° C. 0.1 ml of 0.25% hypo solution, and each was then ripened for 60 minutes. 0.15 ml of 0.2% aqueous chloroauric acid solution was subsequently added to this and the mixture was then further ripened, during which parts of the mixture were taken separately at two points of the ripening time: 90 minutes and 150 minutes after the addition, thus preparing samples Nos. 5 to 10 in the same manner as in Example 1.

Subsequently these samples were subjected to sensitometric evaluation in the same manner as in Example 1. The results obtained are as shown in Table 7.

TABLE 7

| Sample No. | Emulsion No. | Ripening time(min) | Sensitivity | Fog | γ | RMS |
|---|---|---|---|---|---|---|
| 5 | EM-4 | 90 | 85 | 0.06 | 3.50 | 0.182 |
| 6 | EM-4 | 150 | 91 | 0.16 | 3.56 | 0.182 |
| 7 | EM-5 | 90 | 90 | 0.06 | 3.55 | 0.175 |
| 8 | EM-5 | 150 | 95 | 0.13 | 3.62 | 0.175 |
| 9 | EM-6 (invention) | 90 | 100 | 0.06 | 3.60 | 0.158 |
| 10 | EM-6 (invention) | 150 | 120 | 0.08 | 3.75 | 0.158 |

The sensitivity is the reciprocal of the exposure that gives fog +0.4, and the sensitivities of the samples are given in the table with relative values when the sensitivity of sample 9 is regarded as 100.

From the results shown in Table 7 it is apparent that EM-6 prepared in accordance with the production method of the present invention produces fog gently at the time of chemical sensitization, and is improved on the resulting sensitivity itself as well as on the graininess (RMS) as compared to EM-4 and EM-5 prepared in the conventional manner.

COMPARATIVE EXAMPLE 4

The following five different solutions were used to prepare a silver iodobromide emulsion containing 5 mole % of silver iodide. EM-7 used as the seed emulsion is a cubic silver iodobromide emulsion containing 4 mole % of silver iodide. The seed emulsion's mean particle's side length is 0.3 μm, and the extent of the distribution of the particle size is 11%.

| | |
|---|---|
| **Solution A-6** | |
| Ossein gelatin | 55 g |
| Distilled water | 6800 ml |
| 10% aqueous ethanol solution of polyisopropylene-polyethyleneoxy-disuccinic acid ester sodium salt | 8 ml |
| 56% acetic acid | 66 ml |
| 28% aqueous ammonia | 110 ml |
| Seed emulsion (EM-7) | 0.737 mole |
| **Solution B-6** | |
| Ossein gelatin | 64 g |
| KBr | 764.7 g |
| KI | 56.1 g |
| Distilled water to make | 3221 ml |
| **Solution D-6** | |
| $AgNO_3$ | 1149 g |
| Distilled water | 1500 ml |
| 28% aqueous ammonia | 965 ml |
| Distilled water to make | 3221 ml |
| **Solution E-6** | |
| 50% aqueous KBr solution | 500 ml |
| **Solution F-6** | |
| 56% aqueous acetic acid solution | 2000 ml |

By use of a mixing stirrer that is disclosed in Japanese Patent O.P.I. Publication Nos. 92523/1982 and 92524/1982, at 40° C., to Solution A-6 were simultaneously added Solution D-6 and Solution B-6 by the simultaneously mixing method, spending 68.89 minutes that is the minimum adding time to cause no growth of small particles midway. The pAg and pH and the adding rate of Solution D-6 during the simultaneous mixing were controlled as shown in Table 8. The controls of pAg and pH were made with changing the flows of Solution E-6, Solution F-6 and Solution B-6 by a flow-variable roller tube pump.

Two minutes after completion of the addition of Solution D-6, the pH was adjusted to 6.0 by use of Solution F-6.

TABLE 8

| Time | pAg | pH | Adding rate of Solution D-6 (ml/min.) |
|---|---|---|---|
| 0.0 | 9.60 | 9.00 | 15.4 |
| 7.16 | 9.60 | 8.95 | 25.2 |
| 13.17 | 9.60 | 8.89 | 41.1 |
| 21.70 | 9.60 | 8.76 | 68.4 |
| 27.87 | 9.60 | 8.61 | 93.6 |
| | | | Suspended for pAg adjustment |
| 28.87 | 10.5 | 8.61 | 40.6 |
| 39.77 | 10.5 | 8.46 | 46.3 |
| 48.71 | 10.5 | 8.33 | 49.2 |
| 58.77 | 10.5 | 8.18 | 49.7 |

TABLE 8-continued

| Time | pAg | pH | |
|---|---|---|---|
| 68.89 | 10.5 | 8.05 | 49.6 |

The mixture was then washed for desalting in usual manner, and dispersed into an aqueous solution containing 106 g of ossein gelatin, and after that distilled water was added to it to make its whole quantity 3190 ml. The resulting emulsion was regarded as EM-8. The silver halide particles of EM-8 were examined under an electron microscope, and as a result it was found that the extent of the particle size distribution is 16%, and the emulsion contains 15% twin particles with the rest tetradecahedral particles whose particle size is 0.65 μm in terms of a side length of a cube equivalent in the volume thereto.

EXAMPLE 3

The following five different solutions were used to prepare a silver iodobromide emulsion containing 5 mole % of silver iodide in accordance with the production method of the present invention. EM-7 used as the seed emulsion is a cubic silver iodobromide emulsion containing 4 mole % of silver iodide. The seed emulsion's mean particle's side length is 0.3 μm, and the extent of the particle size distribution is 11%.

| | |
|---|---|
| **Solution A-7** | |
| Ossein gelatin | 55 g |
| Distilled water | 6800 ml |
| 10% aqueous ethanol solution of polyisopropylene-polyethyleneoxy-disuccinic acid ester sodium salt | 8 ml |
| 56% acetic acid | 66 ml |
| 28% aqueous ammonia | 110 ml |
| Seed emulsion (EM-7) | 0.737 mole |
| **Solution B-7** | |
| Ossein gelatin | 64 g |
| KBr | 764.7 g |
| KI | 56.1 g |
| Distilled water to make | 3221 ml |
| **Solution D-7** | |
| $AgNO_3$ | 1149 g |
| Distilled water | 1500 ml |
| 28% aqueous ammonia | 965 ml |
| Distilled water to make | 3221 ml |
| **Solution E-7** | |
| 50% aqueous KBr solution | 500 ml |
| **Solution F-7** | |
| 56% aqueous acetic acid solution | 2000 ml |

By use of a mixing stirrer that is disclosed in Japanese Patent O.P.I. Publication Nos. 92523/1982 and 92524/1982, at 40° C., to Solution A-7 were simultaneously added Solution D-7 and Solution B-7 by the simultaneously mixing method, spending 31.93 minutes. The pAg and pH and the adding rate of Solution D-7 during the simultaneous mixing were controlled as shown in Table 9. The controls of pAg and pH were made with changing the flows of Solution E-7, Solution F-7 and Solution B-7 by a flow-variable roller tube pump.

Two minutes after completion of the addition of Solution D-7, the pH was adjusted to 6.0 by use of Solution F-7.

TABLE 9

| Time | pAg | pH | Adding rate of Solution D-7 (ml/min.) |
|---|---|---|---|
| 0.0 | 9.60 | 9.00 | 30.8 |
| 8.44 | 9.60 | 8.84 | 101.2 |
| 13.14 | 9.60 | 8.65 | 174.5 |
| | | | Suspended for pAg adjustment |
| 14.14 | 10.0 | 8.65 | 123.6 |
| 18.28 | 10.0 | 8.48 | 147.8 |
| 22.45 | 10.0 | 8.29 | 157.3 |
| | | | Suspended for pAg adjustment |
| 23.45 | 10.5 | 8.29 | 99.5 |
| 26.87 | 10.5 | 8.18 | 99.5 |
| 31.93 | 10.5 | 8.05 | 99.1 |

The mixture was washed for desalting in usual manner, and dispersed into an aqueous solution containing 106 g of ossein gelatin, and after that distilled water was added to it to make its whole quantity 3190 ml. This emulsion was regarded as EM-9. The silver halide particles of EM-9 were examined under an electron microscope, and as a result it was found that the extent of the particle size distribution is 12%, and the emulsion contains 4% twin particles with the rest tetradecahedral particles whose particle size is 0.65 μm in terms of a side length of a cube equivalent in the volume thereto.

From the results it is understood that as compared to the comparative emulsion EM-8 prepared in the conventional manner, the emulsion by the method of the invention is improved on the particle size distribution as well as on the growing frequency of twin particles, and when comparing the minimum adding time with no growth of small particles, the time is reduced to about one half.

Each of 300 ml was taken from EM-8 and EM-9, and to this was added at 60° C. 0.2 ml of 0.25% hypo solution, and each was ripened for 60 minutes. 0.3 ml of 0.2% aqueous chloroauric acid solution was subsequently added to this, and the mixture was then further ripened, during which ripening samples of the mixture were taken separately at two points of the ripening time: 70 minutes and 120 minutes after the addition, thus preparing samples Nos. 11 to 14 in the same manner as in Example 1.

These samples were then subjected to sensitometric evaluation in the same manner as in Example 1. The obtained results are as shown in Table 10.

TABLE 10

| Sample No. | Emulsion No. | Ripening time(min) | Sensitivity | Fog | γ | RMS |
|---|---|---|---|---|---|---|
| 11 | EM-8 | 70 | 85 | 0.06 | 4.10 | 0.080 |
| 12 | EM-8 | 120 | 92 | 0.14 | 4.25 | 0.080 |
| 13 | EM-9 (invention) | 70 | 100 | 0.06 | 4.22 | 0.070 |
| 14 | EM-9 (invention) | 120 | 120 | 0.08 | 4.30 | 0.070 |

The sensitivity is the reciprocal of the exposure that gives fog +0.4, and the sensitivities of the samples are given in the table with relative values when the sensitivity of sample 13 is regarded as 100.

From the results shown in Table 10 it is apparent that EM-8 prepared in accordance with the production method of the present invention produces fog gently at the time of chemical sensitization, and is improved on the resulting sensitivity itself as well as on the graininess (RMS) as compared to EM-9 prepared in the conventional manner.

What is claimed is:

1. A method of preparing a silver halide emulsion comprising the steps of:

(a) producing monodispersed silver halide particles of cubic and/or tetradecahedral shape in an aqueous hydrophilic colloidal solution, the silver halide particles consisting essentially of silver iodobromide, silver chloroiodobromide or a mixture therefore containing from 0.5 to 10 mole % of silver iodide;

(b) increasing the pAg value of the aqueous hydrophilic colloidal solution by not less than 0.3 either stepwise involving not less than three steps or continuously by adding an aqueous water-soluble silver salt solution and an aqueous water-soluble halide solution to the hydrophilic coloidal solution to form silver halide particles of octahedronal and/or tetradecahedronal shape.

2. A method according to claim 1, wherein said method is for the production of a silver halide emulsion comprising silver halide particles consisting essentially of a silver iodobromide.

3. A method according to claim 1, wherein said method comprises a step of using a seed emulsion.

4. A method according to claim 1, wherein silver halide particles of cubic shape are made present in said hydrophilic colloid solution at the time of initiation of said pAg-increasing step and silver halide particles present in said hydrophilic solution at the time of completion of said pAg-increasing step are in the form of octahedron.

5. A method according to claim 2, wherein said silver halide particles are core/shell type silver halide particles.

6. A method according to claim 5, wherein said core/shell type silver halide particles have a thickness from 0.01 to 0.3 μm.

7. The method of claim 1, further comprising the step of decreasing the size of the silver halide particles after step (a) and before step (b) by decreasing the pAg value.

* * * * *